United States Patent [19]

Wang

[11] Patent Number: 4,745,649

[45] Date of Patent: May 24, 1988

[54] INFLATABLE ARTICLE WITH EDGE CONCEALING MEANS

[76] Inventor: Cheng C. Wang, 7th Floor, No. 37, An-Ho Road, Taipei, Taiwan

[21] Appl. No.: 776,437

[22] Filed: Sep. 16, 1985

Related U.S. Application Data

[63] Continuation-in-part of Ser. No. 738,067, May 24, 1985, Pat. No. 4,651,360, which is a continuation-in-part of Ser. No. 467,546, Feb. 17, 1983, Pat. No. 4,547,919.

[51] Int. Cl.[4] ..... A47C 27/08

[52] U.S. Cl. ..... 5/455; 5/449; 52/23; 297/DIG. 3

[58] Field of Search ..... 5/441, 449, 452, 455, 5/457, 458; 297/DIG. 3; 52/23

[56] References Cited

U.S. PATENT DOCUMENTS

| | | | |
|---|---|---|---|
| 3,017,642 | 1/1962 | Rosenberg et al. | 297/DIG. 3 |
| 3,030,640 | 4/1962 | Gosman | 5/455 |
| 3,788,388 | 12/1973 | Thomas et al. | 5/457 |
| 4,150,447 | 4/1979 | Miller | 5/452 |
| 4,467,484 | 8/1984 | Nagatake et al. | 5/449 |

*Primary Examiner*—Alexander Grosz

*Attorney, Agent, or Firm*—McGlew and Tuttle

[57] ABSTRACT

An inflatable article includes at least one first gas impervious flexible sheet formed into an inflatable envelope having at least one heat-sealed edge by heat sealing, and at least one second sheet heat sealed to the first sheet to form an additional air compartment, wherein the second sheet has at least one marginal edge which is heat sealed along the heat sealed edge or along a seam adjacent to the heat sealed-edge with an adjacent portion thereof extending over the heat-sealed edge. The additional air compartment expands over and conceals the heat-sealed edge upon inflation.

2 Claims, 3 Drawing Sheets

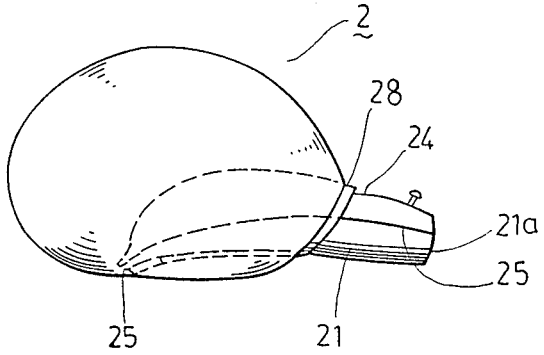
F I G. 4
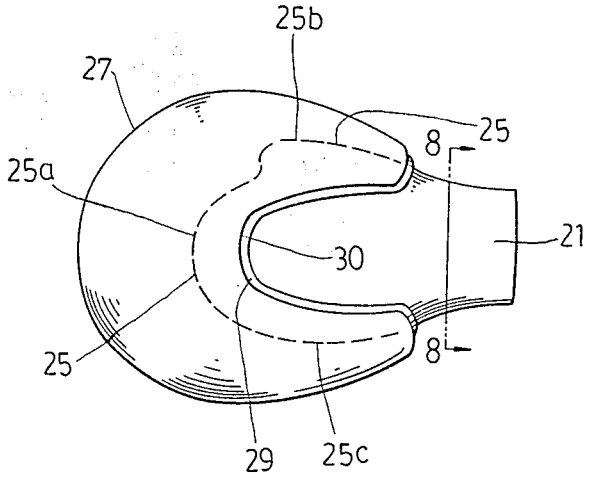
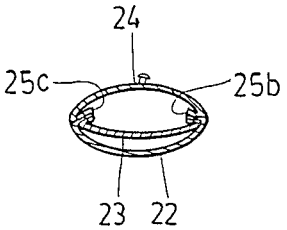
F I G. 6
F I G. 8

INFLATABLE ARTICLE WITH EDGE CONCEALING MEANS

This application is a continuation-in-part of application Ser. No. 738,067 filed on May 24, 1984 now U.S. Pat. No. 4,651,360, which is a continuation-in-part of application Ser. No. 467,546 filed on Feb. 17, 1983 now U.S. Pat. No. 4,547,919.

BACKGROUND OF THE INVENTION

This invention relates to an inflatable article, and particularly to an inflatable article having an inflatable body with at least one additional air compartment formed on/near the heat-sealed edge of the body by heat sealing an additional gas impervious sheet to the main body.

Inflatable articles made by heat sealing one or more pieces of strong plastic sheetings, such as PVC sheeting, include sharp heat seal edges which can harm the users. Therefore, a means whereby the sharp edges can be concealed is needed.

The inflatable article having an inflatable body with an additional air compartment formed thereon was known in the prior art. U.S. Pat. No. 2,170,539 discloses a inflatable toy ballon of irregular shape having sunken portions and projecting portions, the projecting portions being independently formed and superimposed on the main inflatable body of the toy ballon by cementing a separate sheet to the main inflatable body for providing the projecting portions with a measure of rigidity so that these portions cn retain in their desired shape U.S. Pat. No. 1,851,768 discloses a water toy which is provided with inflatable projecting portions at the lower parts thereof for floating the toys in upright position on the water. In neither reference is any description included of means provided to conceal sharp heat-sealed edges.

SUMMARY OF THE INVENTION

It is an object of the invention to provide an inflatable article having an inflatable body with an additional air compartment formed on/near the heat sealed edge of the inflatable body to conceal harmful sharp heat-sealed edge.

This and other objects can be achieved in accordance with the invention through the provision of an inflatable article which comprises at least one first gas impervious flexible sheet formed by heat sealing into an inflatable envelope having at lest one heat-sealed edge, and at least one second gas impervious flexible sheet heat sealed to the first sheet to form an additional air compartment, wherein the second sheet has at least one marginal edge heat sealed to the first sheet along the heat sealed edge, whereby the additional air compartment expands over and hides the heat sealed edge upon inflation.

In accordance with one aspect of the present invention, the inflatable article includes at least one first gas impervious flexible sheet formed by heat sealing into an inflatable envelope having at least one heat-sealed edge, and at least one second gas impervious flexible sheet heat sealed to the first sheet to form an additional air compartment, wherein the second sheet has at least one portion extending over the heat-sealed edge, and at least one marginal edge of the portion is heat sealed along a heat seal seam which is adjacent to the heat seal edge. The marginal edge of the second sheet may be extended in and hidden by the additional air compartment when it is heat sealed.

The present exemplary preferred embodiment will be described in detail with reference to the following drawings, in which:

BRIEF DESCRIPTION OF THE DRAWINGS

FIG. 4 is a perspective view of an inflatable boxing glove according to the present invention;

FIG. 6 is a bottom plan view of the boxing glove of FIG. 4;

FIG. 8 is a sectional side view taken along line 8—8 of FIG. 6.

DETAILED DESCRIPTION OF THE PREFERRED EMBODIMENT

Figure 1:
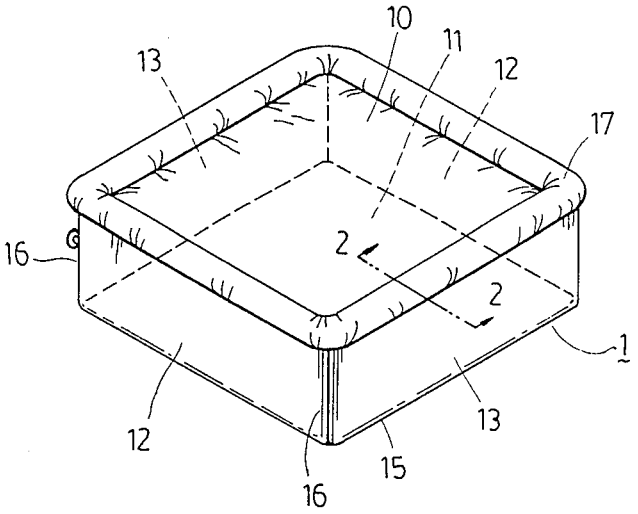
FIG. 1 is a perspective view of a cushion seat according to the present invention.
Figure 2:
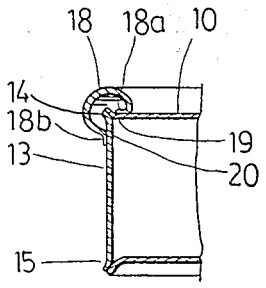
FIG. 2 is a fragmentary sectional view taken along line 2—2 of FIG. 1.
Figure 3:
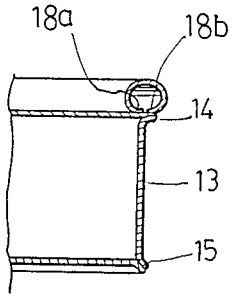
FIG. 3 is a fragmentary sectional view taken along line 2—2 of FIG. 1, the marginal edge portion of the edge concealing sheet being heat sealed in a slightly different way with respect to that of FIG. 2.

Referring to FIGS. 1, 2 and 3, there is shown a seat cushion 1 constituted of sheets 10, 11, 12 and 13 which are heat-sealed together at their edges to form an inflatable seat cushion having four top edges 14, four bottom edges 15 and four side edge 16. Along the top edges 14 are formed a rectangularly looped member 17 which hides the top heat-sealed edges 14. The looped member 17 is formed by cementing an additional one piece sheet 18 to the seat cushion 1, forming an additional air compartment along the top edges 14. The inner marginal edge 18*a* of the sheet 18 is heat sealed to the lateral portion of the sheet 10 of the seat cushion 1 along a loop-shaped heat-sealed seam 19, then the sheet 18 is folded back and extends over the heat sealed edge 14, and the outer marginal edge 18*b* is heat sealed to the upper lateral portions of sheets 12 and 13 along a loop-shaped heat seal seam 20, as shown in FIG. 2. The top edge 14 is formed by butt sealing sheets 10 and 13 at their peripheries. The inner marginal edge 18*a* which is heat sealed is hidden inside the air compartment formed.

Alternatively, the outer marginal edge 18*b* of the sheet 18 can be heat sealed to the edges 14 to form an additional air compartment, as shown in FIG. 3, to expand over and hide the top edges 14. Additionally, the rectangularly looped member 17 can also be formed by heat sealing two or more pieces of gas impervious sheet, other than one piece sheet 18, to the seat cushion 1.

Figure 5:
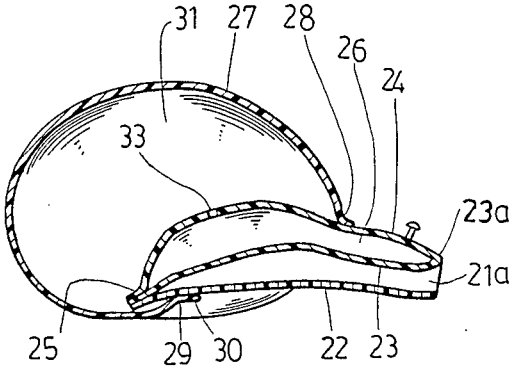
FIG. 5 is a sectional side view of the boxing glove of FIG. 4.

In FIGS. 4, 5 and 6, there is shown an inflatable boxing glove 2 which includes a glove-shaped envelope 21 having an opening 21*a* allowing the user's hand access which is formed by heat sealing two sheets 22 and 23 at their edges. A sheet 24 is superimposed on the sheet 23 and then heat sealed to the heat sealed edge of the glove-shaped envelope 21, forming a sharp surrounding heat-sealed edge 25. In addition, the sheet 24 is also heat-sealed to the edge 23*a* of sheet 23, forming an inflatable envelope 26 for cushioning the user's fist. To conceal the sharp heat sealed edge 25, an edge concealing sheet 27, which has a particular shape and dimension, is heat-sealed to sheet 24 along seam 28 with a portion of its marginal edge. The sheet 27 is then extended over the front portion of sheet 24 and sharp heat-sealed edge 25. The remaining portion 29 of the marginal edge of the sheet 27 is heat sealed to the sheet 22 along seam 30, forming an additional air compartment 31 which hides the sharp edge 25 of the boxing glove.

Figure 7:
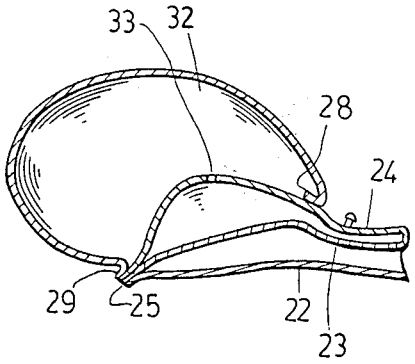
FIG. 7 is a sectional side view of the boxing glove of an other example.

Alternatively, the remaining portion 29 of the marginal edge of the sheet 27 can be heat sealed along the edge 25 as shown in FIG. 7 to form an additional air compartment 32 which will expand over the sharp edge 25 to hide it upon inflation. The compartments 26 and 32 can be communicated one another by providing air passage 33 using any of methods known by those skilled in the art.

It can be appreciated that, when heat-sealing sheets 22, 23 and 24, portions **25*b* and 25*c* of the surrounding edge 25 can be concealed, as shown in FIG. 8. This can be done by forming portions 25*b* and 25*c* firstly, leaving the front portion 25*a* as being opened, and then turning the heat-sealed portions 25*b* and 25*c* to the interior side of the envelope before the heat-sealed portion 25*a*** is formed.

With the invention thus explained, it is apparent that various modifications and variations can be made without departing from the scope of the invention. It is therefore intended that the invention be limited as indicated in the appended claims.

What I claim is:

1. A inflatable article comprising:

first and second gas impervious sheets joined together into an inflatable envelope having at least one seam formed by heat sealing the edges of said first and second flexible sheets, and a third gas impervious sheet overlying at least a portion of said first and second flexible sheets and said seam in one piece to form an additional air compartment superimposed on said envelope, wherein said third sheet has at least one marginal edge heat sealed to said first sheet along one side of said seam and is looped over said seam and heat sealed to said second sheet on the other side of said seam, whereby said additional air compartment conceals said seam upon inflation of said air compartment, said first and second sheets defining sharp, butt sealed, peripheral edges, said third sheet being heat sealed to said second sheet by placing a part of its inner surface adjacent to said second sheet and heat sealing it thereto.

2. An inflatable article as claimed in claim 1, wherein said inflatable envelope is the shape of a seat cushion.

* * * * *